United States Patent [19]

Cosse et al.

[11] 4,351,862

[45] Sep. 28, 1982

[54] CONTINUOUS HOT-DIP COATING OF METAL STRIP

[75] Inventors: Paul Cosse, Bellaire; Jacques Pelerin, Angleur, both of Belgium

[73] Assignee: Centre de Recherches Metallurgiques-Centrum Voor Research In De Metallurgie, Brussels, Belgium

[21] Appl. No.: 212,261

[22] Filed: Dec. 2, 1980

[30] Foreign Application Priority Data

Dec. 5, 1979 [LU] Luxembourg ..... 81955

[51] Int. Cl.[3] ..... C23C 1/02

[52] U.S. Cl. ..... 427/300; 427/432; 427/433; 118/419

[58] Field of Search ..... 427/433, 434.3, 300, 427/349, 282, 432, 209; 118/419, 421, 402, 403, 406

[56] References Cited

U.S. PATENT DOCUMENTS

| | | | |
|---|---|---|---|
| 911,613 | 2/1909 | Roberts | 118/118 |
| 1,289,260 | 12/1918 | Powanda | 118/406 |
| 1,956,466 | 4/1934 | Palm | 118/419 |
| 2,374,926 | 5/1945 | Fink | 427/433 |
| 2,993,470 | 7/1961 | Stickel | 118/407 |
| 4,178,397 | 12/1979 | Lovis | 118/419 |
| 4,198,446 | 4/1980 | Goetz | 427/428 |

FOREIGN PATENT DOCUMENTS

| | | | |
|---|---|---|---|
| 55-11171 | 1/1980 | Japan | 427/300 |
| 55-47374 | 4/1980 | Japan | 427/433 |
| 55-79861 | 6/1980 | Japan | 427/300 |
| 1192515 | 5/1970 | United Kingdom . | |
| 1533193 | 11/1978 | United Kingdom | 427/300 |

*Primary Examiner*—Ralph S. Kendall

*Attorney, Agent, or Firm*—Holman & Stern

[57] ABSTRACT

Metal strip is passed around a cylinder immersed in a bath of molten metal. Selection of one-sided or two-sided coating is made by selecting the position at which the strip enters and leaves the bath relative to the position at which the strip comes into and out of contact with the cylinder, by selecting the level of the bath surface or by moving an auxiliary roll.

11 Claims, 2 Drawing Figures

Fig. 1.
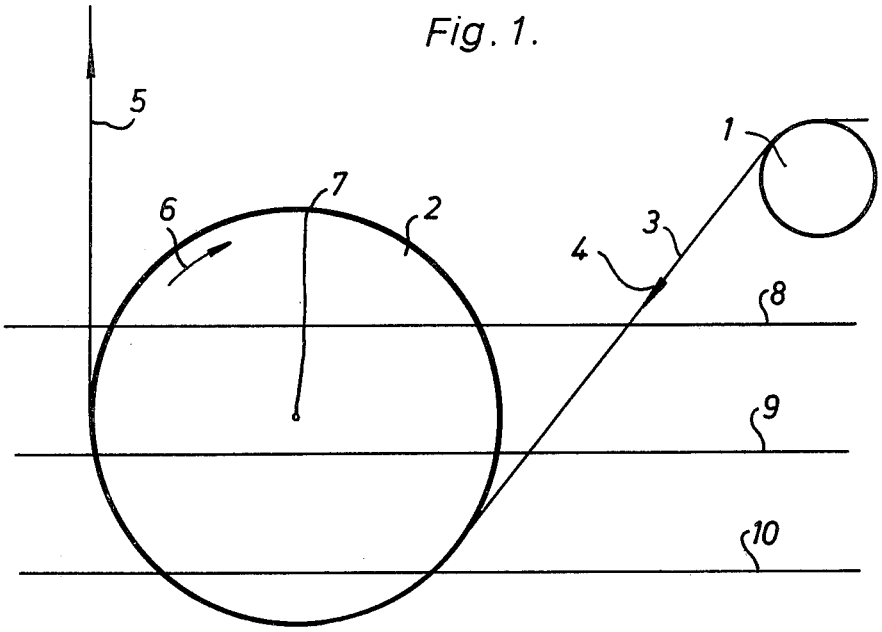
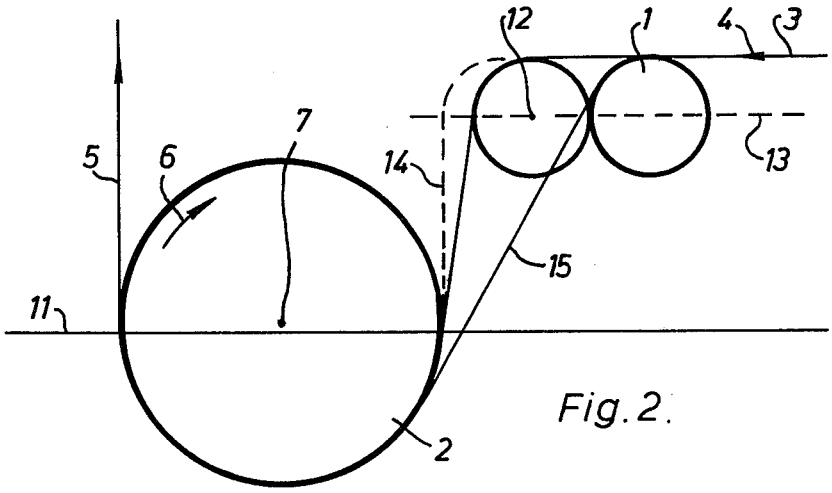
Fig. 2.

CONTINUOUS HOT-DIP COATING OF METAL STRIP

FIELD OF THE INVENTION

The present invention relates to a method of continuously coating metal strip, when the coating is applied by dipping the sheet in a molten metal bath. The method may be applied in particular in the case of galvanization lines which are to be converted from the production of strip coated on a single side or face to the production of strip coated on both sides or faces and vice versa.

For reasons of clarity, the following description mainly relates to galvanization, but it should be noted that the indications given are also valid for coatings other than zinc coatings, as the bath may be constituted by lead, tin, aluminium, etc., or by their alloys, whether mixed or separately.

BACKGROUND OF THE INVENTION

The continuous galvanization methods for thin sheet are well known and at present enable high quality production with an apparatus which is technologically adapted to the operations in question.

Some of these techniques, whatever their intrinsic qualities or particular features, relate specifically to galvanization on both faces. This is carried out in practice by continuously passing steel strip through an immersion tank.

Other methods relate to the galvanization of a single face without leaving any traces of zinc on the other face. By way of example, the thin sheet designed in particular for the manufacture of vehicle bodywork is included in this category, as the non-galvanized surface is designed in particular to receive a paint coating. In this field, there is already proposed a method in which steel strip is brought into contact with a rotary masking cylinder having a horizontal axis which is partially immersed in a bath of liquid zinc. As a result of winding about a portion of the periphery of the masking cylinder, the strip is introduced into the bath under the following conditions: the contact between the strip and the cylinder is established before the introduction of the strip into the bath and is only discontinued after the strip has emerged from the bath. (see British Patent Specification No. 1,533,193).

Up to now, these two types of coating lines have been constituted by specific apparatus which may not be used, even partially, for both types of application.

SUMMARY OF THE INVENTION

The present invention is primarily concerned with a method which enables the coating of metal strip on one or both faces, using all or part of similar and therefore interchangeable equipment.

The present invention provides a method in which one or both faces of a metal strip are coated with a metal coating by contacting the strip to be coated with the peripheral surface of rotary cylinder having a substantially horizontal axis, which is immersed in a bath of liquid metal, and by introducing the strip into the bath by winding the sheet over its entire width about a portion of the periphery of the cylinder, without going beyond the edges of the cylinder. The outer cylindrical surface must be non-wettable by the molten method.

The present invention is also concerned with solving a profitability problem with which metallurgists are often confronted; that the amounts of strip to be galvanized on a single face are generally insufficient to bring a plant to full production capacity. The possibility of using the same plant not only for strip to be galvanized on a single face but also for strip to be galvanized on both faces constitutes a particularly advantageous solution to this profitability problem.

DESCRIPTION OF THE PREFERRED EMBODIMENTS

For this purpose, the conversion of the lines for coating metal strip on a single surface into lines for coating both faces and vice versa is carried out by modifying the position of the points of the beginning and end of contact between the strip and the masking cylinder relative to the position of the points at which the strip enters and emerges from the bath. By using a masking cylinder at least one of whose walls may not be wetted, i.e., does not take up the coating.

The present invention is also concerned with the achievement of differential galvanization on both faces in a single operation. This relates to the achievement of a coating of molten metal directly and simultaneously on both sides of the strip, the coatings having different thicknesses, and in which the thinner coating may be modified to a predetermined value.

The position of the points of beginning and end of contact relative to the points of entry and emergence may be modified by modifying the relative position of the masking cylinder and the molten metal bath, e.g. by raising or lowering the cylinder.

A coating may be produced on a single face by ensuring (a) that the point of contact of the strip with the masking cylinder is located upstream of the point at which the strip enters the bath and (b) that the point at which the strip ceases to contact the masking cylinder is located downstream of the point at which the strip is discharged from the bath.

A coating may be produced on both sides by ensuring (a) that the point of contact of the strip with the masking cylinder is located downstream of the point at which the strip enters the bath or (b) that the point at which the strip ceases to contact the masking cylinder is located upstream of the point at which the strip emerges from the bath.

The position of the masking cylinder partially immersed in the metal bath is advantageously used for coating one or both faces. The position of the masking cylinder completely immersed in the metal bath is advantageously used for coating both faces.

Using the method described above, metallurgists have a simple, convenient, and less costly way of using the same coating line for coating one or both faces of metal strip.

In one mode of operation, the masking cylinder, (about a portion of the periphery of which the sheet is wound in the bath such that its axis of rotation, in practice horizontal), is located with respect to the upper surface of the metal, (in the tank containing the metal), at a level such that the upper face of the strip section entering into the bath is only in contact with the molten metal for a very short period, and not at all at the time of discharge. It is thus possible to dispose only a very thin layer of molten metal on this upper face. The thickness of this layer obviously relates to the speed of displacement of the sheet and the length of travel of the upper face in the bath before coming into contact with the peripheral surface of the masking cylinder.

In practice, in order to obtain this differential coating, the axis of the masking cylinder is located in a horizontal position, either slightly below the upper level of the metal, or preferably at this level, and more preferably above this level. The length of travel of the upper face of the strip in the metal bath is also adjustable as a function of the inclination of the strip to the upper surface of the bath, at the moment when the strip enters the bath. The strip is generally discharged perpendicular to the surface of the bath.

The arrangement described above has the advantage that the masking roll also may be used simultaneously as a roll for drying one surface. In addition, this has the advantage of a lower consumption of gas for drying.

It is worth noting here that the face on which a very thin layer of zinc (for example less tha 5 μm) is disposed may be of the "galvannealed" type, i.e. a layer of Fe-Zn alloy obtained by heat treatment after galvanization and providing a weldable product designed to enable painting. This product therefore has properties similar to those of sheet glavanized on a single face. The face coated with a few microns of zinc or intermetallic Fe-Zn, which do not impair weldability and painting in practice, is thus protected against corrosion.

The invention will be described further, by way of example, with reference to the accompanying drawings, in which:

FIG. 1 is a schematic side view of a galvanizing arrangement; and

FIG. 2 is a similar view of another galvanizing arrangement.

Referring to FIG. 1, for a given position of an auxiliary roll 1, the position of a masking roll 2 relative to the upper surface of a bath of molten metal is selectable for the three types of galvanization envisaged in accordance with the present invention.

Steel strip 3 to be galvanized is displaced in the direction of the arrows 4 and 5, the masking roll 2 rotating in the direction of the arrow 6 about its theoretically horizontal axis 7, so that the strip is in non-slipping contact with it.

In accordance with the level 8, 9 or 10 of the upper surface of the bath, it can be seen immediately that the galvanization of the strip is carried out on both faces (level 8), or on both faces but differentially (level 9), or on a single face (level 10). For simplicity of representation the emerging strip is shown vertical in all cases, and the method is carried out as though the level of the upper surface of the molten metal remained fixed and the masking roll 2 was displaced relative to this level.

According to FIG. 2, it should be considered that the masking roll 2 rotates in the direction of the arrow 6 about its axis 7, which is fixed with respect to the level 11 of the upper surface of the bath. The auxiliary roll 1 is displaced horizontally, its axis 12 remaining parallel to itself while being displaced in the horizontal plane 13. According to the position of this auxiliary roll 1, the strip being supplied is either in the vertical position 14 corresponding to galvanization on a single face or in the position 15 corresponding to differential galvanization on both faces. It is obvious that the difference in thickness of the zinc layers deposited on the two faces of the strip is in a direct relationship with the relative position of the rolls 1 and 2 and the level 11.

It is also possible to modify the position of the two rolls 1 and 2 in a suitable manner in order to obtain a desired result.

The present invention is further concerned with remedying the difficulties which sometimes arise with the positioning of the beginning or end of contact of the strip with the masking cylinder, either in the bath or outside of the bath.

For this purpose, at least one guide roll (not shown) is disposed in the vicinity of the point at which the strip should come into contact with the masking cylinder which is immersed in the bath and/or the point at which the strip should be separated from the masking cylinder after its winding about the peripheral surface of the cylinder.

Preferably, use is made of at least one entry guide roll (not shown) in the vicinity of the point at which the strip should enter into contact with the masking cylinder, the guiding action of this roll being terminated by a tensioning of the strip and by pressure exerted on the strip on the masking cylinder.

Preferably, also at least one exit guide roll (not shown) is used in the vicinity of the point at which the strip should be separated from the masking cylinder, the guiding action of this roll being terminated by a drying action which involves tensioning or compression of the strip on the masking cylinder.

The simultaneous use of at least one roll in the vicinity of the points of beginning and end of contact of the strip with the masking cylinder, with the specific actions mentioned above according to the position, does not depart from the scope of the invention.

A modification of the relative position of this entry guide roll (located at the point at which the sheet should come into contact with the masking cylinder) and the masking cylinder may also enable the galvanization of a single face or both faces (idem for an exit guide roll at the output).

The combination of the modifications of the relative positions of the masking cylinder in respect of the level of the galvanization bath, on one hand, and of the masking cylinder in respect of the guide roll or rolls, on the other hand, enables conversion from single-face coating to double-face or differential double-face coating and vice versa.

The present invention is also concerned with remedying the difficulties possibly encountered in ensuring the protection of the sheet against oxidation before and possibly after coating. For this purpose, the upper portion of a chamber containing the bath of molten metal and the masking cylinder are preferably enveloped in a leak-tight casing which contains a non-oxidising, preferably reducing, protective atmosphere, for example at atmosphere constituted by $H_2+N_2$.

The embodiment described above is particularly advantageous in the above-mentioned case of a coating line which may be converted from a single face coating to two face coating and vice versa.

We claim:

1. In a method of continuous hot-dip coating of a two sided metal strip in molten metal wherein an outer side is afforded a full-coating and an inner side is afforded a coating infinitely variable from no-coating up to a full-coating; wherein the metal strip is brought into substantially non-slipping contact on its inner side with a masking roll cylinder rotating about a substantially horizontal axis and which is at least partially immersed in a bath of the molten metal, by introducing the strip into the bath of molten metal, passing the strip around the masking roll so that the inner side of the strip is in contact with a portion of the outer cylindrical surface of the masking roll and then terminating the contact and removing the strip from the molten metal, the outer side of the strip being in contact with the molten metal during the entire passage around the masking roll; and wherein the metal strip is guided by an auxilliary guide roll prior to entry into the molten metal bath, said auxiliary guide roll having an axis parallel to and above the axis of the masking roll; the improvements comprising:

affording a masking roll cylinder whose outer surface consists essentially of a material which is non-wettable by the molten metal; and modifying the positions of the point at which the inner side first contacts the surface of the masking roll and the point at which the inner side terminates its contact with the masking roll, thereby permitting varying the exposure of the inner side to the molten metal from substantially no exposure resulting in substantially no-coating up to substantially full exposure resulting in a full-coating.

2. The method of claim 1 with the further improvement of varying the relative position of the masking roll and the upper level of the molten metal bath, so that the inner side of the metal strip may be variably exposed to the molten metal from substantially no exposure up to substantial exposure, prior to the metal strip contacting the masking roll.

3. The method of claim 1 or 2 with the further improvement of varying the contact length between the metal strip and the masking roll, in order to pass from a one-side coating operation to a two-side coating operation or vice-versa.

4. The method of claim 3 with the further improvement of varying said contact length by varying the angle at which the strip enters the molten metal bath.

5. The method of claim 4 with the further improvement of varying said angle of modifying the position of the auxilliary guide roll over which the strip passes before entering the molten metal bath.

6. The method of claim 5 with the further improvement that the bath and the cylinder are contained in a chamber having an upper part enveloped in a leak-tight casing containing a non-oxidizing protective atmosphere.

7. The method of claim 6 wherein the atmosphere is a reducing atmosphere.

8. The method of claim 7 wherein the metal strip is a steel strip and the metal bath is a galvanizing bath.

9. The method of claim 1 or 2 with the further improvement that the bath and the masking roll are contained in a chamber having an upper part enveloped in a leak-tight casing containing a non-oxidizing protective atmosphere.

10. The method of claim 9 wherein the atmosphere is a reducing atmosphere.

11. The method of claim 10 wherein the metal strip is a steel strip and the metal bath is a galvanizing bath.

* * * * *